US009128400B2

(12) United States Patent
Takahashi et al.

(10) Patent No.: US 9,128,400 B2
(45) Date of Patent: Sep. 8, 2015

(54) TONER

(75) Inventors: Toru Takahashi, Abiko (JP); Katsuhisa Yamazaki, Numazu (JP); Shuhei Moribe, Mishima (JP); Daisuke Yoshiba, Suntou-gun (JP); Daisuke Tsujimoto, Toride (JP); Masami Fujimoto, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/990,367

(22) PCT Filed: Dec. 15, 2011

(86) PCT No.: PCT/JP2011/079750

§ 371 (c)(1), (2), (4) Date: May 29, 2013

(87) PCT Pub. No.: WO2012/090844

PCT Pub. Date: Jul. 5, 2012

(65) Prior Publication Data

US 2013/0302730 A1 Nov. 14, 2013

(30) Foreign Application Priority Data

Dec. 28, 2010 (JP) ..... 2010-293013

(51) Int. Cl.

| | |
|---|---|
| ***G03G 9/087*** | (2006.01) |
| ***G03G 9/08*** | (2006.01) |
| ***G03G 9/083*** | (2006.01) |
| ***G03G 9/09*** | (2006.01) |
| ***G03G 9/097*** | (2006.01) |

(52) U.S. Cl.

CPC ..... *G03G 9/08797* (2013.01); *G03G 9/0821* (2013.01); *G03G 9/0835* (2013.01); *G03G 9/08755* (2013.01); *G03G 9/08782* (2013.01); *G03G 9/08788* (2013.01); *G03G 9/08795* (2013.01); *G03G 9/091* (2013.01); *G03G 9/0904* (2013.01); *G03G 9/09783* (2013.01)

(58) Field of Classification Search

CPC ... G03G 5/0592; G03G 5/0596; G03G 5/056; G03G 9/08755; G03G 9/08788; G03G 9/08797

USPC ..... 430/111.4, 109.4

See application file for complete search history.

(56) References Cited

U.S. PATENT DOCUMENTS

| | | | |
|---|---|---|---|
| 5,354,637 | A | 10/1994 | Shimamura et al. |
| 5,406,357 | A | 4/1995 | Nakahara et al. |
| 5,415,967 | A | 5/1995 | Sakashita et al. |
| 5,436,701 | A | 7/1995 | Shimojo et al. |
| 5,447,813 | A | 9/1995 | Hagiwara et al. |
| 5,547,796 | A | 8/1996 | Kohtaki et al. |
| 5,707,771 | A | 1/1998 | Matsunaga |
| 5,716,746 | A | 2/1998 | Mikuriya et al. |
| 5,968,701 | A | 10/1999 | Onuma et al. |
| 6,020,102 | A | 2/2000 | Fujimoto et al. |
| 6,077,638 | A | 6/2000 | Tanikawa et al. |
| 6,120,961 | A | 9/2000 | Tanikawa et al. |
| 6,156,471 | A | 12/2000 | Kobori et al. |
| 6,187,496 | B1 | 2/2001 | Tanikawa et al. |
| 6,203,959 | B1 | 3/2001 | Tanikawa et al. |
| 6,235,441 | B1 | 5/2001 | Tanikawa et al. |
| 6,426,169 | B1 | 7/2002 | Onuma et al. |
| 6,458,499 | B1 | 10/2002 | Onuma et al. |
| 6,541,174 | B1 | 4/2003 | Tanikawa et al. |
| 6,586,151 | B1 | 7/2003 | Naka et al. |
| 6,589,701 | B2 | 7/2003 | Yamazuki et al. |
| 6,653,036 | B1 | 11/2003 | Tanikawa et al. |
| 6,670,087 | B2 | 12/2003 | Fujikawa et al. |
| 6,703,176 | B2 | 3/2004 | Naka et al. |
| 6,875,549 | B2 | 4/2005 | Yamazaki et al. |

(Continued)

FOREIGN PATENT DOCUMENTS

| | | | |
|---|---|---|---|
| CN | 1536449 | A | 10/2004 |
| CN | 101317135 | A | 12/2008 |

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 178-182.*

(Continued)

*Primary Examiner* — Christopher Rodee

(74) *Attorney, Agent, or Firm* — Fitzpatrick, Cella, Harper and Scinto

(57) ABSTRACT

To provide a toner that can keep its melt-sticking to sleeve from occurring and, even in double-sided printing, can keep high-temperature offset from occurring and obtain high-quality images on both the surface and the back. The toner comprises toner particles each of which contains a binder resin containing a resin formed by the reaction of i) a resin (A) having a softening point TA (° C.) of 70° C. to 105° C. and having a peak top of endothermic peaks at 55° C. to 120° C. with ii) a resin (B) having a softening point TB (° C.) of 120° C. to 160° C. and having a peak top of endothermic peaks at 55° C. to 120° C., and, in its viscoelasticity characteristics, has a storage elastic modulus at temperature 180° C. (G'180) of $3.0\times10^3$ Pa to $3.0\times10^4$ Pa, where the loss tangent tan δ has at least one peak having a peak top within the range of 50° C. to 70° C. and, when peak top temperature of the peak is represented by T(° C.), the loss tangent at T+10(° C.) [tan δ(T+10)] is 1.0 to 1.5 and the ratio of tan δ(T+10)/tan δ(110) is 0.8 to 1.5.

2 Claims, 1 Drawing Sheet

(56) References Cited

U.S. PATENT DOCUMENTS

| | | | | |
|---|---|---|---|---|
| 6,881,527 | B2 | 4/2005 | Moribe et al. | |
| 7,001,703 | B2 | 2/2006 | Moribe et al. | |
| 7,097,951 | B2 | 8/2006 | Moribe et al. | |
| 7,125,636 | B2 | 10/2006 | Miyazaki et al. | |
| 7,147,981 | B2 | 12/2006 | Fujikawa et al. | |
| 7,150,953 | B2 | 12/2006 | Yamazaki et al. | |
| 7,160,660 | B2 | 1/2007 | Dojo et al. | |
| 7,267,919 | B2 | 9/2007 | Moribe et al. | |
| 7,273,686 | B2 | 9/2007 | Onuma et al. | |
| 7,288,354 | B2 | 10/2007 | Moribe et al. | |
| 7,351,509 | B2 | 4/2008 | Moribe et al. | |
| 7,422,832 | B2 | 9/2008 | Ogawa et al. | |
| 7,537,877 | B2 | 5/2009 | Yoshiba et al. | |
| 7,544,455 | B2 | 6/2009 | Yoshiba et al. | |
| 7,638,251 | B2 | 12/2009 | Yamazaki et al. | |
| 7,700,254 | B2 | 4/2010 | Moribe et al. | |
| 7,740,998 | B2 | 6/2010 | Yamazaki et al. | |
| 7,796,926 | B2 | 9/2010 | Matsuda et al. | |
| 7,855,042 | B2 | 12/2010 | Kobori et al. | |
| 7,897,316 | B2 | 3/2011 | Yamazaki et al. | |
| 8,026,030 | B2 | 9/2011 | Moribe et al. | |
| 8,057,977 | B2 | 11/2011 | Moribe et al. | |
| 8,067,477 | B2 | 11/2011 | Hirota et al. | |
| 8,084,178 | B2 | 12/2011 | Tosaka et al. | |
| 8,211,608 | B2 | 7/2012 | Mizuhata et al. | |
| 8,236,470 | B2 | 8/2012 | Ueno et al. | |
| 8,293,447 | B2 | 10/2012 | Yamazaki et al. | |
| 8,501,377 | B2 | 8/2013 | Takahashi et al. | |
| 8,512,925 | B2 | 8/2013 | Moribe et al. | |
| 2002/0098431 | A1 * | 7/2002 | Fujikawa et al. | 430/111.4 |
| 2010/0316947 | A1 | 12/2010 | Mizuhata et al. | |
| 2013/0244166 | A1 | 9/2013 | Yamazaki et al. | |
| 2013/0252167 | A1 | 9/2013 | Moribe et al. | |
| 2013/0309603 | A1 | 11/2013 | Takahashi et al. | |

FOREIGN PATENT DOCUMENTS

| | | | |
|---|---|---|---|
| CN | 101611093 | A | 12/2009 |
| CN | 101657492 | A | 2/2010 |
| JP | 8-234480 | A | 9/1996 |
| JP | 2002-221813 | A | 8/2002 |
| JP | 2002-318471 | A | 10/2002 |
| JP | 2004-264483 | A | 9/2004 |
| JP | 2007-183382 | A | 7/2007 |
| JP | 2010-260886 | A | 11/2010 |
| TW | 200421054 | A | 10/2004 |
| TW | 200632600 | A | 9/2006 |
| TW | 200937147 | A | 9/2009 |

OTHER PUBLICATIONS

Liu, Yeting et al. "Study of glass transition and enthalpy relaxation of mixtures of amorphous sucrose and amorphous tapioca starch syrup solid by differential scanning calorimetry (DSC)" Journal of Food Engineering 81 (2007) pp. 599-610.*

Russian Office Action dated May 27, 2014 in Russian Application No. 2013135269.

Yoshiba, et al., U.S. Appl. No. 14/005,250, filed Sep. 13, 2013.

Terauchi, et al., U.S. Appl. No. 13/922,205, filed Jun. 19, 2013.

PCT International Search Report and Written Opinion of the International Searching Authority, International Application No. PCT/JP2011/079750, Mailing Date Jan. 31, 2012.

Chinese Office Action dated Dec. 1, 2014 in Chinese Application No. 201180063408.8.

Taiwanese Office Action dated Aug. 15, 2014 in Taiwanese Application No. 100148929.

* cited by examiner

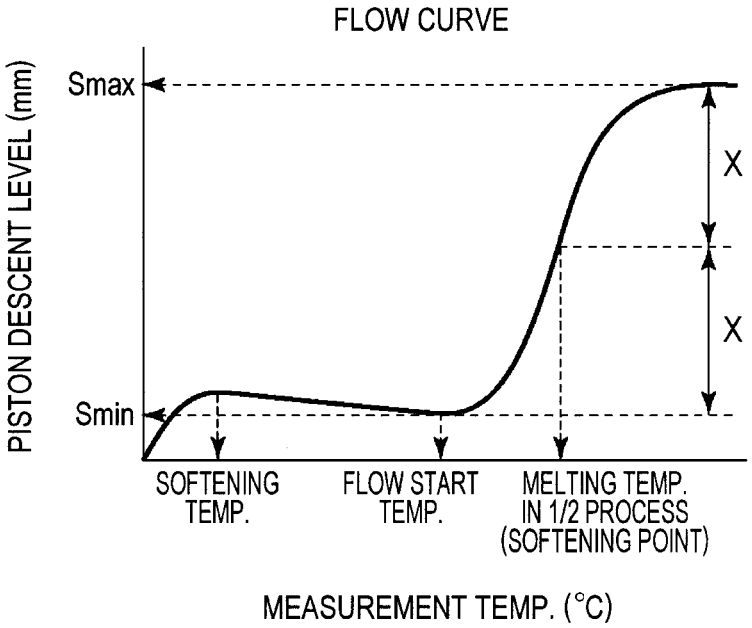
FLOW CURVE
PISTON DESCENT LEVEL (mm)
Smax
Smin
X
X
SOFTENING TEMP.
FLOW START TEMP.
MELTING TEMP. IN 1/2 PROCESS (SOFTENING POINT)
MEASUREMENT TEMP. (°C)

TONER

TECHNICAL FIELD

This invention relates to a toner used in an image forming method for rendering electrostatic latent images visible in electrophotography.

BACKGROUND ART

Image forming apparatus employing electrophotography are severely sought to be made higher in speed and higher in reliability. For example, the apparatus have begun to be used also for printing of high-definition images such as graphic designs, and further for light-duty printing (uses for the print-on-demand (POD) that enables printing in a great variety and a small volume, where documents can be edited of course, also copied and bound as well by means of a personal computer), which is required to be more reliable.

Further, as transfer materials to be used, a great variety of sheets of paper are recently used, such as reclaimed paper with a large surface unevenness and coated paper with a smooth surface. In order to cope with surface properties of such transfer materials, a fixing assembly is preferably used which affords a wide fixing nip like that of a soft roller or belt roller type. However, making the fixing nip wide enlarges the area of contact between a toner and a fixing roller to tend to cause what is called high-temperature offset in which a fused toner sticks to the fixing roller. Since the image forming apparatus are also used in bookbinding and the like as the uses for POD, there is also a strong desire for double-sided print. That is, a copying machine is desired which can reproduce images in a high quality on various transfer materials and on their both sides.

To meet such demand, it is particularly important to improve the toner in its fixing performance.

The storage elastic modulus (G') and loss elastic modulus (G") that are of dynamic viscoelasticity characteristics of the toner and the loss tangent tan δ (G"/G') that is defined as the ratio of the former to the latter are known as one of physical properties which govern the fixing performance of the toner.

In PTL 1, in order to keep a toner from causing high-temperature offset and keep a transfer material from winding around a fixing roller, it is proposed to specify the shape of a fixing nip zone and also control the toner to have a tan δ at temperature 120° C. of from 1.7 to 5.0. However, to cope with more various image forming apparatus and transfer materials, it is insufficient to only control viscoelasticity characteristics at such a one-point temperature of 120° C.

In PTL 2, a technique is also proposed in which the ratio of G' and value of tan δ of a toner are specified within a plurality of temperature ranges so as to improve the toner in its fixing performance and high-temperature offset resistance. However, the toner disclosed in PTL 2 has so high an absolute value for the tan δ that the toner is soft, and hence, to cope with more various image forming apparatus and transfer materials, there has been room for improvement.

In PTL 3, a technique is still also proposed in which, in a toner making use of as a binder resin a resin formed by mixture of a crystalline polyester and a non-crystalline polyester, the toner is controlled to have tan δ and G' at temperature 120° C. so as to be improved in a balance between fixing performance and high-temperature offset. However, since a crystalline polyester and a non-crystalline polyester are used in mixture, a difference in degree to which the crystalline polyester is compatibilized may come about because of a difference in heat history especially where images are formed on both sides of a transfer material having surface unevenness, to cause non-uniform fixing between images on the surface and images on the back.

That is, in the above toners, to cope with more various image forming apparatus and transfer materials, there still has remained room for improvement.

CITATION LIST

Patent Literature

PTL 1: Japanese Patent Application Laid-open No. 2004-264483

PTL 2: Japanese Patent Application Laid-open No. 2007-183382

PTL 3: Japanese Patent Application Laid-open No. 2002-318471

SUMMARY OF INVENTION

Technical Problem

An object of the present invention is to provide a toner that has resolved the above problems.

More specifically, an object of the present invention is to provide a toner that can keep its melt-sticking to sleeve (developing sleeve) and high-temperature offset from occurring even where various image forming apparatus and transfer materials are used.

Another object of the present invention is to provide a toner which, where images are formed on both sides of a transfer material, can obtain high-quality images on both the surface and the back.

Solution to Problem

The present invention that is to resolve the above problems is concerned with a toner comprising toner particles each of which contains a binder resin and a colorant; wherein the binder resin comprises a resin formed by the reaction of a resin (A) and a resin (B):

i) the resin (A) having a softening point TA (° C.) of from 70° C. to 105° C. and having a peak top of endothermic peaks at from 55° C. to 120° C. in a DSC curve as measured with a differential scanning calorimeter, ii) the resin (B) having a softening point TB (° C.) of from 120° C. to 160° C. and having a peak top of endothermic peaks at from 55° C. to 120° C. in a DSC curve as measured with the differential scanning calorimeter;

and wherein in viscoelasticity characteristics of the toner measured at a frequency of 6.28 rad/sec;

I) the toner has a storage elastic modulus at temperature 180° C. (G'180) of from $3.0\times10^3$ Pa to $3.0\times10^4$ Pa, where;

II) in a chart taking temperature as x-axis and loss tangent tan δ as y-axis;

a) the loss tangent tan δ has at least one peak having a peak top within the range of from 50° C. to 70° C. and;

b) when peak top temperature affording the peak top of the peak is represented by T(° C.), the loss tangent at T+10(° C.) [tan δ(T+10)] is from 1.0 to 1.5 and;

c) the ratio of the tan δ(T+10) to the loss tangent at 110° C. [tan δ(110)], tan δ(T+10)/tan δ(110), is from 0.8 to 1.5.

Advantageous Effects of Invention

According to the present invention, a toner can be provided which can keep its melt-sticking to sleeve and high-temperature offset from occurring even where various image forming apparatus and transfer materials are used.

A toner can also be provided which, where images are formed on both sides of a transfer material, can obtain high-quality images on both the surface and the back.

Further features of the present invention will become apparent from the following description of exemplary embodiments with reference to the attached drawing.

BRIEF DESCRIPTION OF DRAWING

FIGURE is a diagram of a flow curve.

DESCRIPTION OF EMBODIMENTS

Studies made by the present inventors have revealed that the above problems can be resolved by using two types of specific resins and controlling the viscoelasticity of the toner in a broad temperature range.

First, the viscoelastic behavior of the toner is described along the flow of fixing.

Unfixed toner images held on a transfer material are fused by heat and fixed by pressure, chiefly at a fixing nip zone in a fixing assembly. Inasmuch as the viscoelasticity of the toner is balanced in a temperature range at the fixing initial stage, the heat and the pressure are uniformly conducted with ease, and hence any non-uniform fixing can be kept from occurring. Also, at a point of time where the unfixed toner images held on the transfer material have passed through the fixing nip zone and the transfer material come separated from a fixing member such as a fixing roller, the toner heated to a high temperature and pressed against the fixing roller tends to stick to the roller, and hence the controlling of its viscoelasticity in the state of high temperature at the fixing latter stage is essential for keeping any high-temperature offset from occurring.

Further, where the double-sided printing is performed, it follows that the toner having first been fixed to the transfer material again passes through the fixing step, and hence a difference in gloss tends to come between the surface and the back or the offset tends to occur. Thus, it is very important to balance the viscoelasticity at the time of fusing.

Studies on a toner having the above properties have reached a finding that it is important for the toner to satisfy the following characteristics.

That is, it is important that the toner has, in viscoelasticity characteristics measured at a frequency of 6.28 rad/sec, a storage elastic modulus at temperature 180° C. (G'180) of from $3.0\times10^3$ Pa to $3.0\times10^4$ Pa, where, in a chart taking temperature as x-axis and loss tangent tan δ as y-axis, the loss tangent tan δ has at least one peak having a peak top within the range of from 50° C. to 70° C. and, when peak top temperature affording the peak top is represented by T(° C.), the loss tangent at T+10(° C.) [tan δ(T+10)] is from 1.0 to 1.5 and the ratio of the tan δ(T+10) to the loss tangent at 110° C. [tan δ(110)], tan δ(T+10)/tan δ(110), is from 0.8 to 1.5.

The loss tangent tan δ is the ratio of the loss elastic modulus (G") to the storage elastic modulus (G'), (G"/G'). Commonly, the storage elastic modulus (G') expresses elasticity, and is an index of the energy of being stored by which a material acts to return to original when it has deformed by the force received from the outside. On the other hand, the loss elastic modulus (G") is an index of the energy of being lost as heat following up the force received when the material has deformed by the force received from the outside. Also, the tan δ is an index that expresses the balance between viscosity and elasticity, and it shows that, the closer to 1 the tan δ is, the better the balance between viscosity and elasticity is.

The peak of the tan δ comes as a result that any lowering of the elasticity stabilizes a little, and the temperature at which the peak appears can be said to be the temperature at which the phase transition from a glassy state to a super-cooled liquid completes in the whole resin. Accordingly, the tan δ peak top temperature T(° C.) is considered to be the temperature at which the toner begins to show molecular motion and begins to undergo fixing. In the present invention, the toner is required to have this peak within the range of from 50° C. to 70° C. If the peak is beyond 70° C., the fixing may be hindered to cause non-uniform fixing. If it is less than 50° C., the toner may come soft to cause high-temperature offset.

Further, it is necessary to control the tan δ that stands from T+10(° C.) to 110° C.; the former being temperature a little higher than the temperature at which the fixing begins, and the latter being temperature at which a low-softening component [chiefly the resin (A)] is considered to melt completely. That is, the closer to 1 the value of tan δ(T+10)/tan δ(110) is, the more the toner can enjoy the balance between viscosity and elasticity thereof in the temperature range contributing to the fixing and the better the balance of action can be which is between heat and pressure applied to the toner at the time of fixing. Stated specifically, good fixing can be performed where the value of tan δ(T+10)/tan δ(110) is from 0.8 to 1.5. If this value is less than 0.8, the viscosity at 100° C. is considered to be so high as to make the pressure not uniformly applicable to tend to cause non-uniform fixing. If on the other hand this value is more than 1.5, the elasticity at 110° C. is so high as to make the heat not uniformly applicable to tend to cause the non-uniform fixing.

The toner stands high in temperature when the transfer material passes through the fixing nip zone, where, for keeping the toner from sticking to the fixing roller, the elasticity in a high-temperature region may be controlled, and this can keep high-temperature offset from occurring. More specifically, the toner is required to have a storage elastic modulus at temperature 180° C. (G'180) of from $3.0\times10^3$ Pa to $3.0\times10^4$ Pa. If the toner has a storage elastic modulus (G'180) of lower than $3.0\times10^3$ Pa, it may cause high-temperature offset, and if it has a storage elastic modulus (G'180) of higher than $3.0\times10^4$ Pa, its fixing performance may be hindered to cause non-uniform fixing.

The binder resin to be contained in toner particles is described next.

The binder resin to be contained in the toner of the present invention contains a resin formed by the reaction of a resin (A) with a resin (B). The resin (A) has a softening point TA (° C.) of from 70° C. to 105° C. (preferably from 75° C. to 90° C.) and has a peak top of endothermic peaks at from 55° C. to 120° C. in a DSC curve. The resin (B) has a softening point TB (° C.) of from 120° C. to 160° C. (preferably from 130° C. to 150° C.) and has a peak top of endothermic peaks at from 55° C. to 120° C. in a DSC curve.

If the resin (A) has a softening point TA of lower than 70° C., the temperature affording the peak of the tan δ lowers, and also the toner has a high viscosity when the tan δ is at the peak. As the result, the toner may melt-stick to the developing sleeve at the time of development. If on the other hand the resin (A) has a softening point TA of higher than 105° C., the toner has a strong elasticity at 110° C., resulting in a small value of tan δ(110). As the result, the toner tends to cause non-uniform fixing.

If the resin (B) has a softening point TB of lower than 120° C., the toner has also a small value of G'180, and hence tends to cause high-temperature offset. If on the other hand the resin (B) has a softening point TB of higher than 160° C., the toner may have so large a value of G'180 as to consequently cause non-uniform fixing.

The binder resin according to the present invention is one containing a resin formed by the reaction of the resin (A) with the resin (B), having the above characteristic features, and is one made to have a high molecular weight while having the features of both the resins, and thereby having further improved the toner in its high-temperature offset resistance.

The endothermic peaks of a DSC curve of the binder resin as measured with a differential scanning calorimeter are described next. Endothermic peaks observed in binder resins used commonly in toners are peaks due to enthalpy relaxation or due to heat of fusion of a crystalline component.

The enthalpy relaxation is seen where, immediately after a polymer has undergone phase transition from a glassy state to a super-cooled liquid, its molecules move so as to be oriented, and is seen in a resin the molecular chains of which tend to come to be oriented. It also depends on cooling speed at which the polymer is cooled from the super-cooled liquid into glass, and there is a tendency for the peaks to appear more largely as the cooling speed is higher.

The heat of fusion of a crystalline component is, as well known in crystalline polyesters or waxes, the heat energy that is necessary to break mutual action between molecules standing oriented uniformly, to make the polymer undergo phase transition from a crystalline state to a liquid state.

That is, the endothermic peaks of a DSC curve in the present invention show that the phase transition of binder resin components has taken place. That the phase transition takes place accelerates the molecular motion of molecular chains of the binder resin, as so considered. That the binder resin has such endothermic peaks enables control of melting at the molecular level, and has enabled control of the viscoelasticity characteristics of the toner in the present invention, as so considered.

Measurement by differential scanning calorimetry will be described later in detail. The endothermic peaks in the present invention are concerned with the endothermic calorie that is found when the binder resin is first heated to 200° C. to melt, and then, after cooling to harden, again heated to melt. That the endothermic peaks appear also in the course of the second heating shows that the binder resin according to the present invention is a resin having a strong crystallinity and being readily capable of undergoing molecular orientation. Because of such a resin, it can maintain as a resin standing incorporated in the toner the endothermic peaks even where it has been made into toner through melt kneading. Since it has endothermic peaks in the second-time DSC curve, the same performance as that on the first time can be obtained also when the toner has passed through the fixing assembly twice, and high-quality images can be obtained on both sides of the transfer material.

The endothermic peaks in the present invention refer to peaks having an endothermic calorie of 0.20 J/g or more. The presence of the endothermic peaks in an endothermic calorie of 0.20 J/g or more is considered to make the molecular motion take place quickly, and this enables the non-uniform fixing to be further kept from occurring.

The viscoelasticity of toner that is characteristic of the present invention may be adjusted by controlling the mass ratio of the resin (A) to the resin (B) and the gel content thereof. Then, if the viscoelasticity characteristics of the toner can not be satisfied even with use of the resin giving the stated endothermic peaks, the toner may cause non-uniform fixing and/or high-temperature offset to make any high-quality images not obtainable. If on the other hand a resin not giving the stated endothermic peaks in a DSC curve is used, even though it has been able to control the viscoelasticity characteristics of the toner, the non-uniform fixing may occur on the side of a transfer material having second time passed through the fixing assembly during the double-sided printing, to make any high-quality images not obtainable.

In carrying out the reaction of the resin (A) with the resin (B) in the present invention, the resins may preferably be in a mass ratio (A:B) in the range of from 60:40 to 95:5. As long as they are within this range, the toner can well keep the balance of the tan δ while well keeping its high-temperature offset resistance.

Further, the binder resin may preferably have THF-insoluble matter therein in an amount of from 10% by mass to 30% by mass. The THF-insoluble matter in the binder resin refers to THF-insoluble matter separated by Soxhlet extraction carried out after the resin (A) and the resin (B) have been mixed. The THF-insoluble matter may be contained in the resin (A) or may be contained in the resin (B). It may also be THF-insoluble matter made up by cross-linking reaction when the resin (A) and the resin (B) are mixed.

As long as the THF-insoluble matter in the binder resin is within the above range, the toner can well be kept from causing high-temperature offset.

Further, the gel of the resin may preferably be prepared by a method in which the resin (A) and the resin (B) are mixed to subject them cross-linking reaction. These two resins may be participated in cross-linking by a wet process, and this makes the binder resin improved in uniformity and makes it easy to control the viscoelasticity characteristics of the toner, showing a tendency to much better keep non-uniform fixing and high-temperature offset from occurring.

The binder resin to be used in the present invention may include the following: Styrene resins, styrene-acrylic resins, polyester resins, polyol resins, polyvinyl chloride resins, phenol resins, natural resin modified phenol resins, natural resin modified maleic acid resins, acrylic resins, methacrylic resins, polyvinyl acetate resins, silicone resins, polyurethane resins, polyamide resins, furan resins, epoxy resins, xylene resins, polyvinyl butyral resins, terpene resins, coumarone indene resins, and petroleum resins. In particular, preferably usable resins are styrene-acrylic resins, polyester resins, and hybrid resins formed by mixture of polyester resins and vinyl resins or by partial reaction of the both.

As a binder resin that may readily bring about enthalpy relaxation in the course of the second-time heating, which is characteristic of the present invention, a linear binder resin is preferred. Further, as a binder resin that may readily give crystalline peaks in the course of the second-time heating, a binder resin is preferred which makes use of a monomer readily developable of crystallinity. In particular, it is much preferable to use a monomer the intermolecular mutual action of which is strong enough to some degree to restore its crystallinity even if it has once melted. Polyester resins are particularly preferable in view of their readiness to introduce crystalline components thereinto.

Polyester resin preferable usable in the present invention has components as shown below.

As a dibasic carboxylic acid component, it may include the following dicarboxylic acids and derivatives thereof: Benzenedicarboxylic acids such as phthalic acid, terephthalic acid and isophthalic acid, or anhydrides or lower alkyl esters thereof; alkyldicarboxylic acids such as succinic acid, adipic acid, sebacic acid and azelaic acid, or anhydrides or lower alkyl esters thereof; alkenylsuccinic acids or alkylsuccinic acids, such as n-dodecenylsuccinic acid and n-dodecylsuccinic acid, or anhydrides or lower alkyl esters thereof; unsaturated dicarboxylic acids such as fumaric acid, maleic acid, citraconic acid and itaconic acid, or anhydrides or lower alkyl esters thereof.

In order to orient part of high-molecular chains of the binder resin to make it have crystallinity, it is preferable to use an aromatic dicarboxylic acid, which has a firm planar structure and in which electrons standing non-localized by a π electron system are present in so large a number as to make the resin readily undergo molecular orientation by π-π mutual action. Terephthalic acid and isophthalic acid are particularly preferred, as being readily capable of having straight-chain structure. This aromatic dicarboxylic acid may preferably be in a content of 50 mol % or more, much preferably 70 mol % or more, and particularly preferably 80 mol % or more, in the acid component constituting the polyester resin. Such a case makes a crystalline resin readily obtainable, and makes endothermic-peak temperatures readily controllable.

As a dihydric alcohol component, it may include the following: Ethylene glycol, polyethylene glycol, 1,2-propanediol, 1,3-propanediol, propylene glycol, 1,3-butanediol, 1,4-butanediol, 2,3-butanediol, diethylene glycol, triethylene glycol, 1,5-pentanediol, 1,6-hexanediol, neopentyl glycol, 2-methyl-1,3-propanediol, 2-ethyl-1,3-hexanediol, 1,4-cyclohexanedimethanol (CHDM), hydrogenated bisphenol A, a bisphenol derivative represented by the formula (1):

(1)

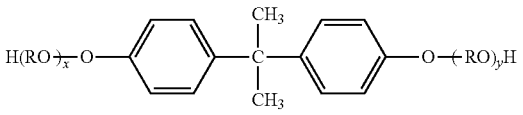

wherein R represents an ethylene group or a propylene group, x and y are each an integer of 0 or more, and an average value of x+y is 0 to 10;

and derivatives thereof, and a diol represented by the formula (2):

(2)

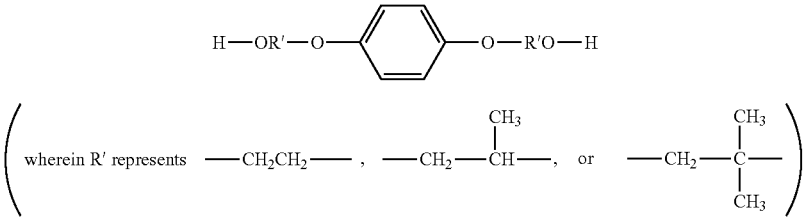

Of these, from the viewpoint of orienting part of molecules of the binder resin to make it have crystallinity, an aliphatic alcohol is preferable as being less causative of steric hindrance, and an aliphatic alcohol having 2 to 6 carbon atoms is preferred.

The binder resin has a high crystallinity if an alcohol readily capable of having straight-chain structure is used alone, and hence it may unwantedly loose its amorphous nature. Accordingly, where the binder resin should be made to have an appropriately loose crystal structure, neopentyl glycol, 2-methyl-1,3-propanediol, 2-ethyl-1,3-hexanediol, cyclohexanedimethanol or the like may be used, which has on the side chain a substituent capable of loosening the crystallinity sterically while keeping the straight-chain structure. Such an alcohol component may preferably be in a content of from 20 mole % to 50 mole %, and further preferably from 25 mole % to 40 mole %, in the whole alcohol component.

The polyester resin preferably usable in the present invention may contain, in addition to the above dicarboxylic acid compound and dihydric alcohol compound, a monobasic carboxylic acid compound, a monohydric alcohol compound, a tribasic or higher carboxylic acid compound or a trihydric or higher alcohol compound as a constituent.

The monobasic carboxylic acid compound may include aromatic carboxylic acids having 30 or less carbon atoms, such as benzoic acid and p-methylbenzoic acid, and aliphatic carboxylic acids having 30 or less carbon atoms, such as stearic acid and behenic acid. The monohydric alcohol compound may also include aromatic alcohols having 30 or less carbon atoms, such as benzyl alcohol, and aliphatic alcohols having 30 or less carbon atoms, such as lauryl alcohol, cetyl alcohol, stearyl alcohol and behenyl alcohol. The tribasic or higher carboxylic acid compound may include trimellitic acid, trimellitic anhydride and pyromellitic acid. The trihydric or higher alcohol compound may also include trimethylol propane, pentaerythritol and glycerol.

Incidentally, when the resin (B) is synthesized, it may be made to have a higher molecular weight and higher softening point by setting polymerization temperature or polymerization time higher or longer than when the resin (A) is synthesized.

There are no particular limitations on how to produce the polyester resin usable as the binder resin, and any known method may be used. For example, the carboxylic acid compound and alcohol compound described above may be put together into processing, and then put to polymerization through esterification reaction, or ester exchange reaction, and condensation reaction to produce the polyester resin. In polymerization for the polyester resin, a polymerization catalyst may be used, as exemplified by titanium tetrabutoxide, dibutyltin oxide, tin acetate, zinc acetate, tin disulfide, antimony trioxide and germanium dioxide.

The polyester resin may also preferably have a glass transition temperature of from 40° C. or more to 60° C. or less for the resin (A), and similarly from 50° C. or more to 70° C. or less for the resin (B), from the viewpoint of fixing performance and storage stability.

The resin (A) and the resin (B) may also much preferably have, in molecular weight distribution measured by gel permeation chromatography (GPC) of THF-soluble matter, a peak(s) in the following molecular weight region. The resin (A) may much preferably have at least one peak in the region of molecular weight of from 3,000 to 10,000 from the viewpoint of fixing performance and storage stability. The resin (B) may much preferably have at least one peak in the region of molecular weight of from 12,000 to 18,000 from the viewpoint of better keeping non-uniform fixing from occurring.

In the present invention, a release agent may optionally be used in order to provide the toner with releasability. As the release agent, an aliphatic hydrocarbon wax is preferred. Such an aliphatic hydrocarbon wax may include the following: Low-molecular weight alkylene polymers obtained by polymerizing alkylenes by radical polymerization under high pressure or by polymerization under low pressure in the presence of a Ziegler catalyst; alkylene polymers obtained by thermal decomposition of high-molecular weight alkylene polymers; synthetic hydrocarbon waxes obtained from distillation residues of hydrocarbons obtained by the Arge process from synthetic gases containing carbon monoxide and hydrogen, and synthetic hydrocarbon waxes obtained by hydrogenation of the same; and any of these aliphatic hydrocarbon waxes fractionated by utilizing press sweating, solvent fractionation or vacuum distillation.

The hydrocarbon, serving as a matrix of the above aliphatic hydrocarbon wax, may include the following: Those synthesized by reacting carbon monoxide with hydrogen in the presence of a metal oxide type catalyst (mostly catalysts of a two or more multiple system), as exemplified by hydrocarbon compounds synthesized by the Synthol method or the Hydrocol process (making use of a fluidized catalyst bed); hydrocarbons having up to about several hundred carbon atoms, obtained by the Arge process (making use of a fixed catalyst bed) which can obtain waxy hydrocarbons in a large quantity; and hydrocarbons obtained by polymerization of alkylenes such as ethylene in the presence of a Ziegler catalyst. Of these hydrocarbons, in the present invention, they may preferably be less- and small-branched, saturated long straight chain hydrocarbons. In particular, hydrocarbons synthesized by the method not relying on the polymerization of alkylenes are preferable also in view of their molecular weight distribution.

For example, such a hydrocarbon may specifically include the following: VISCOL (registered trademark) 330-P, 550-P, 660-P, TS-200 (available from Sanyo Chemical Industries, Ltd.); HIWAX 400P, 200P, 100P, 410P, 420P, 320P, 220P, 210P, 110P (available from Mitsui Chemicals, Inc.); SASOL H1, H2, C80, C105, C77 (available from Schumann Sasol Co.); HNP-1, HNP-3, HNP-9, HNP-10, HNP-11, HNP-12 (available from Nippon Seiro Co., Ltd.); UNILIN (registered trademark) 350, 425, 550, 700, UNICID (registered trademark) 350, 425, 550, 700 (available from Toyo-Petrolite Co., Ltd.); and Japan wax, bees wax, rice wax, candelilla wax, carnauba wax (available from CERARICA NODA Co., Ltd.).

One or two or more types of release agent(s) may also optionally be used in combination with the hydrocarbon wax. The release agent(s) usable in combination may include the following:

Oxides of aliphatic hydrocarbon waxes, such as polyethylene oxide wax, or block copolymers of these; waxes composed chiefly of a fatty ester, such as carnauba wax, sasol wax and montanate wax; those obtained by subjecting part or the whole of fatty esters to deoxidizing treatment, such as dioxidized carnauba wax; saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; fatty acid amides such as linolic acid amide, oleic acid amide and lauric acid amide; saturated fatty acid bisamides such as methylenebis(stearic acid amide), ethylenebis(capric acid amide), ethylenebis(lauric acid amide) and hexamethylenebis(stearic acid amide); unsaturated fatty acid amides such as ethylenebis(oleic acid amide), hexamethylenebis(oleic acid amide), N,N'-dioleyladipic acid amide and N,N'-dioleylsebasic acid amide; aromatic bisamides such as m-xylenebisstearic acid amide and N,N'-distearylisophthalic acid amide; fatty acid metal salts (those commonly called metal soap) such as calcium stearate, calcium laurate, zinc stearate and magnesium stearate; grafted waxes obtained by grafting vinyl monomers such as styrene or acrylic acid to aliphatic hydrocarbon waxes; partially esterified products of polyhydric alcohols with fatty acids, such as monoglyceride behenate; and methyl esterified products having a hydroxyl group, obtained by hydrogenation of vegetable fats and oils.

As the timing at which the release agent(s) is/are added, it may be added at the time of melt kneading during the production of the toner, or may be added when the binder resin is produced. The timing may appropriately be selected from any existent methods. Any of these release agents may be used alone or in combination of two or more types.

The release agent(s) may preferably be added in an amount of from 1 part by mass or more to 20 parts by mass or less, based on 100 parts by mass of the binder resin.

The toner of the present invention may be either of a magnetic toner and a non-magnetic toner.

When used as the magnetic toner, it may preferably contain a magnetic material. As the magnetic material, an iron oxide such as magnetite, maghemite or ferrite may be used. The magnetic material may also preferably be, for the purpose of being improved in its fine dispersibility in toner particles, subjected to treatment to apply shear to slurry at the time of production, to first disintegrate any agglomerates of the magnetic material. The magnetic material may preferably be contained in the toner particles in an amount of from 25% by mass or more to 45% by mass or less, and much preferably from 30% by mass or more to 45% by mass or less.

Such a magnetic material may have a coercive force of from 1.6 kA/m or more to 12.0 kA/m or less, a saturation magnetization of from 50.0 $Am^2/kg$ or more to 200.0 $Am^2/kg$ or less (preferably from 50.0 $Am^2/kg$ or more to 100.0 $Am^2/kg$ or less), as magnetic properties under application of a magnetic field of 795.8 kA/m. It may further preferably be one having a residual magnetization of from 2.0 $Am^2/kg$ or more to 20.0 $Am^2/kg$ or less. The magnetic properties of the magnetic material may be measured with a vibration type magnetic-force meter, e.g., VSM P-1-10 (manufactured by Toei Industry Co., Ltd.).

When used as the non-magnetic toner, one or two or more types of carbon black or other known pigment(s) or dye(s) may be used as a colorant(s). The colorant(s) may preferably be in a content of from 0.1 part by mass or more to 60.0 parts by mass or less, and much preferably from 0.5 part by mass or more to 50.0 parts by mass or less, based on 100.0 parts by mass of the resin components.

In the toner of the present invention, a charge control agent may preferably be used in order to stabilize the charging performance of the toner. The charge control agent may commonly be contained in an amount of from 0.1 part by mass or more to 10 parts by mass or less, and much preferably from 0.1 part by mass or more to 5 parts by mass or less, based on 100 parts by mass of the binder resin, which may differ depending on the type thereof and the physical properties of other toner constituent materials.

As the charge control agent, an organic metal complex or chelate compound, having a central metal, is effective. As its examples, it may include monoazo metal compounds, acetylacetone metal compounds, aromatic hydroxycarboxylic acids, and metal complexes or metal salts of aromatic hydroxycarboxylic acids or aromatic dicarboxylic acids. A known charge control resin may also be used. Any of these may be used alone or in combination of two or more types.

Where any metallic cross-linkage formed by mutual action with carboxyl groups the binder resin has should be introduced into the toner, a charge control agent capable of giving the metallic cross-linkage may be used, as exemplified by a salicylic acid aluminum compound.

What is usable as the charge control agent may include, as specific examples thereof SPILON BLACK TRH, T-77, T-95 (available from Hodogaya Chemical Co., Ltd.), and BONTRON (registered trademark) S-34, S-4, S-4, E-84, E-88, E-89 (available from Orient Chemical Industries Ltd.).

In the toner of the present invention, a fluidity improver having a small number-average primary-particle diameter and having a BET specific surface area of from 50 $m^2/g$ or more to 300 $m^2/g$ or less may preferably externally be added as an inorganic fine powder to the toner particles. As the fluidity improver, any agent may be used as long as it can improve the fluidity of the toner by its external addition to the toner particles, as seen in comparison before and after its addition.

For example, it may include the following: Fluorine resin powders such as fine vinylidene fluoride powder and fine polytetrafluoroethylene powder; fine silica powders such as wet-process silica and dry-process silica, and treated silica powders obtained by subjecting these silica powders to surface treatment with a silane coupling agent, a titanium coupling agent or a silicone oil. A preferred fluidity improver is what is called dry-process silica or fumed silica. For example, it is what utilizes the heat decomposition oxidation reaction of silicon tetrachloride gas in oxygen and hydrogen, the reaction scheme of which is as shown below.

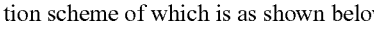

$$SiCl_4+2H_2+O_2 \rightarrow SiO_2+4HCl$$

The fluidity improver may also be a composite fine powder of silica with other metal oxide, obtained by using, in the above production step, other metal halide such as aluminum chloride or titanium chloride together with the silicon halide.

As to its particle diameter, it is preferable to use fine silica powder having an average primary-particle diameter within the range of from 0.001 μm or more to 2 μm or less, and particularly preferably within the range of from 0.002 μm or more to 0.2 μm or less.

Further, it is preferable to use as the fluidity improver a treated fine silica powder obtained by making hydrophobic the above fine silica powder produced by vapor phase oxidation of a silicon halide. In the treated fine silica powder, a fine silica powder is particularly preferred which has been so treated that its hydrophobicity as measured by a methanol titration test shows a value within the range of from 30 or more to 80 or less.

As a method for making hydrophobic, the hydrophobicity is provided by chemical treatment with an organosilicon compound capable of reacting with or physically adsorbing the fine silica powder. As a preferable method, the fine silica powder produced by vapor phase oxidation of a silicon halide may be treated with an organosilicon compound.

Such an organosilicon compound may include the following: Hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, 1-hexamethyldisiloxane, 1,3-divinyltetramethyldisiloxane, 1,3-diphenyltetramethyldisiloxane, and a dimethylpolysiloxane having 2 to 12 siloxane units per molecule and having a hydroxyl group bonded to each Si in its units positioned at the terminals. Any of these may be used alone or in the form of a mixture of two or more types.

The inorganic fine powder may be treated with silicone oil, and also may be treated therewith in combination with the above hydrophobic treatment.

As preferred silicone oil, one having a viscosity at 25° C. of from 30 $mm^2/s$ or more to 1,000 $mm^2/s$ or less may be used. For example, dimethylsilicone oil, methylphenylsilicone oil, α-methylstyrene modified silicone oil, chlorophenylsilicone oil and fluorine modified silicone oil are particularly preferred.

As methods for the treatment with silicone oil, available are the following: A method in which the fine silica powder treated with a silane coupling agent and the silicone oil are directly mixed by means of a mixing machine such as Henschel mixer; a method in which the silicone oil is sprayed on the fine silica powder serving as a base; and a method in which the silicone oil is first dissolved or dispersed in a suitable solvent, and then the fine silica powder is mixed, followed by removal of the solvent. It is more preferable that the fine silica powder having been treated with the silicone oil is heated to 200° C. or more (preferably 250° C. or more) in an inert gas to make surface coatings stable.

As a preferred silane coupling agent, it may include hexamethyldisilazane (HMDS).

In the present invention, what is preferred is one having been treated by a method in which the silica is beforehand treated with a coupling agent and thereafter treated with silicone oil or a method in which the silica is simultaneously treated with a coupling agent and silicone oil.

The inorganic fine powder may preferably be externally added in an amount of from 0.01 part by mass or more to 8 parts by mass or less, and much preferably from 0.1 part by mass or more to 4 parts by mass or less, based on 100 parts by mass of the toner particles.

Other external additives may also optionally be added to the toner of the present invention. For example, they are a charging auxiliary agent, a conductivity-providing agent, a fluidity-providing agent, an anti-caking agent, and fine resin particles or inorganic fine particles which act as a release agent, a lubricant or an abrasive at the time of heat-roller fixing.

The lubricant may include polyfluoroethylene powder, zinc stearate powder and polyvinylidene fluoride powder; in particular, polyvinylidene fluoride powder is preferred. The abrasive may include cerium oxide powder, silicon carbide powder and strontium titanate powder. These external additives may thoroughly be mixed with toner particles by means of a mixing machine such as Henschel mixer.

The toner of the present invention may be obtained by, e.g., well mixing the binder resin and the colorant, and optionally the other additives by means of a mixing machine such as Henschel mixer or a ball mill, then melt-kneading the resultant mixture by means of a heat kneading machine such as a heat roll, a kneader or an extruder, then cooling the kneaded product to solidity, followed by pulverization by means of a grinding machine and then classification by means of a classifier to obtain toner particles, and further well mixing the toner particles with the external additives by means of a mixing machine such as Henschel mixer.

As the mixing machine, it may include the following: Henschel Mixer (manufactured by Mitsui Mining & Smelting Co., Ltd.); Super Mixer (manufactured by Kawata MFG Co., Ltd.); Conical Ribbon Mixer (manufactured by Y.K. Ohkawara Seisakusho); Nauta Mixer, Turbulizer, and Cyclomix (manufactured by Hosokawa Micron Corporation); Spiral Pin Mixer (manufactured by Pacific Machinery & Engineering Co., Ltd.); and Rhedige Mixer (manufactured by Matsubo Corporation).

As the kneading machine, it may include the following: KRC Kneader (manufactured by Kurimoto, Ltd.); Buss-Kneader (manufactured by Coperion Buss Ag.); TEM-type Extruder (manufactured by Toshiba Machine Co., Ltd.); TEX Twin-screw Extruder (manufactured by The Japan Steel Works, Ltd.); PCM Kneader (manufactured by Ikegai Corp.); Three-Roll Mill, Mixing Roll Mill, and Kneader (manufactured by Inoue Manufacturing Co., Ltd.); Kneadex (manufactured by Mitsui Mining & Smelting Co., Ltd.); MS-type Pressure Kneader, and Kneader-Ruder (manufactured by Moriyama Manufacturing Co., Ltd.); and Banbury Mixer (manufactured by Kobe Steel, Ltd.).

As the grinding machine, it may include the following: Counter Jet Mill, Micron Jet, and Inomizer (manufactured by Hosokawa Micron Corporation); IDS-type Mill, and PJM Jet Grinding Mill (manufactured by Nippon Pneumatic MFG Co., Ltd.); Cross Jet Mill (manufactured by Kurimoto, Ltd.); Ulmax (manufactured by Nisso Engineering Co., Ltd.); SK Jet O-Mill (manufactured by Seishin Enterprise Co., Ltd.); Criptron (manufactured by Kawasaki Heavy Industries, Ltd); Turbo Mill (manufactured by Turbo Kogyo Co., Ltd.); and Super Rotor (manufactured by Nisshin Engineering Inc.).

As the classifier, it may include the following: Classyl, Micron Classifier, and Spedic Classifier (manufactured by Seishin Enterprise Co., Ltd.); Turbo Classifier (manufactured by Nisshin Engineering Inc.); Micron Separator, Turboprex (ATP), and TSP Separator (manufactured by Hosokawa Micron Corporation); Elbow Jet (manufactured by Nittetsu Mining Co., Ltd.); Dispersion Separator (manufactured by Nippon Pneumatic MFG Co., Ltd.); and YM Microcut (manufactured by Yasukawa Shoji K.K.).

As a sifter used to sieve coarse powder, it may include the following: Ultrasonics (manufactured by Koei Sangyo Co., Ltd.); Rezona Sieve, and Gyro Sifter (manufactured by Tokuju Corporation); Vibrasonic Sifter (manufactured by Dulton Company Limited); Sonicreen (manufactured by Shinto Kogyo K.K.); Turbo-Screener (manufactured by Turbo Kogyo Co., Ltd.); Microsifter (manufactured by Makino mfg. co., ltd.); and circular vibrating screens.

Measurement of Softening Point:

The softening point of the binder resin is measured with a constant-load extrusion type capillary rheometer "Flow Characteristics Evaluation Instrument FLOW TESTER CFT-500D" (manufacture by Shimadzu Corporation) according to a manual attached to the instrument. In this instrument, a constant load is applied from above a measuring sample by means of a piston, during which the measuring sample, which is filled in a cylinder, is melted by raising its temperature (heating). The measuring sample melted is extruded from a die provided at the bottom of the cylinder, where a flow curve showing the relationship between the level of descent of the piston and the temperature is obtainable. In the present invention, "Melting temperature in ½ process" prescribed in the manual attached to the "Flow Characteristics Evaluation Instrument FLOW TESTER CFT-500D" is set as the melting point.

Here, the value of "Melting temperature in ½ process" is calculated in the following way. First, the value of ½ is found which is of a difference between the level of descent Smax of the piston at the point of time where the sample has completely flowed out and the level of descent 5 min of the piston at the point of time where the sample has begun to flow out [this value is represented by X. X=(Smax−Smin)/2]. Then, the temperature of the flow curve at the time the level of descent of the piston comes to the sum of X and 5 min in the flow curve is the "Melting temperature in ½ process" (a diagram of the flow curve is shown in FIGURE).

As the measuring sample, a cylindrical sample of about 8 mm in diameter is used which is obtained by molding about 1.0 g of the toner by compression at about 10 MPa for about 60 minutes, in an environment of 25° C. and using a tablet compressing machine (e.g., NT-100H, manufactured by NPa System Co., Ltd.).

Conditions for measurement with CFT-500D are as shown below.

Test mode: Heating method.
Start temperature: 30° C.
Ultimate temperature: 200° C.
Measurement interval: 1.0° C.
Heating rate: 4.0° C./min.
Piston sectional area: 1.000 $cm^2$.
Testing load (piston load): 10.0 kgf (0.9807 MPa).
Preheating time: 300 seconds.
Aperture diameter of die: 1.0 mm.
Length of die: 1.0 mm.

Measurement of Endothermic Peak Temperature:

The endothermic peak temperature is measured according to ASTM D3418-82 by using a differential scanning calorimetry analyzer "Q1000" (manufactured by TA Instruments Japan Ltd.). The temperature at the detecting portion of the instrument is corrected on the basis of melting points of indium and zinc, and the amount of heat is corrected on the basis of heat of fusion of indium.

Stated specifically, about 5 mg of the resin is precisely weighed, and this is put into a pan made of aluminum and an empty pan made of aluminum is used as reference. Measurement is made at a heating rate of 10° C./min within the measurement temperature range of from 30° C. to 200° C. Here, in the measurement, the resin is first heated to 200° C., then cooled to 30° C. at a cooling rate of 10° C./min, and thereafter heated again at a heating rate of 10° C./min. The physical properties specified in the present invention are determined from endothermic peaks in a DSC curve in the temperature range of from 30° C. to 200° C. in the course of this second-time heating. The endothermic calorie AH of these endothermic peaks each is determined from the integral value of a region (endothermic peaks) surrounded by the DSC curve and the base line.

Measurement of Viscoelasticity Characteristics:

The viscoelasticity characteristics of the toner in the present invention are measured in the following way.

A rotary flat-plate rheometer ARES (manufactured by TA Instruments) is used as a measuring instrument.

A sample prepared by pressure-molding the toner in the shape of a disk of 7.9 mm in diameter and 2.0±0.3 mm in thickness in an environment of 25° C. by means of a tablet press is used as a measuring sample.

The sample is fitted to parallel plates, and is heated to 100° C. from room temperature (25° C.) over a period of 15 minutes, where, after the sample has been adjusted in shape, it is cooled to the temperature at which the viscoelasticity is begun to be measured, and then the measurement is started. Here, it is important for the sample to be so set that the normal force at the initial stage comes to 0. Also, during the measurement after that, any effect of the normal force may be cancelled as described below, by placing the automatic tension adjustment in the on state.

The measurement is made under the following conditions.

(1) Parallel plates of 7.9 mm in diameter are used.
(2) Frequency is set at 6.28 rad/sec (1.0 Hz).
(3) Applied-strain initial value (strain) is set to be 0.1%.

(4) Measured at a heating rate (ramp rate) of 2.0° C./min between 30° C. and 200° C. Here, in the measurement, it is made under conditions set in the following automatic adjustment mode. The measurement is made in an automatic strain adjustment mode.

(5) Maximum applied strain is set at 20.0%.

(6) Maximum allowed torque is set at 200.0 g·cm, and minimum allowed torque at 0.2 g·cm (7) Strain adjustment is set to be 20.0%-off current strain. In the measurement, an automatic tension adjustment mode is employed.

(8) Automatic tension direction is set as compression.

(9) Initial static force is set at 10.0 g, and automatic tension sensitivity at 40.0 g.

(10) The automatic tension is operated under conditions of a sample modulus of $1.0\times10^3$ Pa or more.

Measurement of THF-Insoluble Matter Content:

The THF-insoluble matter in the binder resin is measured in the following way.

About 1.0 g of the binder resin is weighed (W1 g), which is then put in a cylindrical filter paper (e.g., trade name: No. 86R, 28 mm×100 mm in size, available from Advantec MFS, Inc.) weighed previously, and this is set on a Soxhlet extractor. Then, extraction is carried out for 16 hours using 200 ml of tetrahydrofuran (THF) as a solvent. At this point, the extraction is carried out at such a reflux speed that the extraction cycle of the solvent is one time per about 5 minutes.

After the extraction has been completed, the cylindrical filter paper is taken out and air-dried, and thereafter vacuum-dried at 40° C. for 8 hours to measure the mass of the cylindrical filter containing extraction residues, where the mass (W2 g) of the extraction residues is calculate by subtracting the mass of the cylindrical filter.

Then, calculation may be made as shown in the following expression (1) to determine the THF-insoluble matter.

$$\text{THF-insoluble matter(\% by mass)}=(W2/W1)\times100 \quad (1).$$

Measurement of Molecular Weight Distribution of THF-Soluble Matter:

The molecular weight distribution of the binder resin is measured in the following way by gel permeation chromatography (GPC).

First, the resin is dissolved in tetrahydrofuran (THF) at room temperature over a period of 24 hours. Then, the solution obtained is filtered with a solvent-resistant membrane filter "MAISHORIDISK" (available from Tosoh Corporation) of 0.2 μm in pore diameter to make up a sample solution. Here, the sample solution is so controlled that the component soluble in THF is in a concentration of about 0.8% by mass. Using this sample solution, the measurement is made under the following conditions.

Instrument: HLC8120 GPC (detector: RI) (manufactured by Tosoh Corporation).

Columns: Combination of seven columns, SHODEX KF-801, KF-802, KF-803, KF-804, KF-805, KF-806 and KF-807 (available from Showa Denko K.K.).

Eluent: Tetrahydrofuran (THF).

Flow rate: 1.0 ml/min.

Oven temperature: 40.0° C.

Amount of sample injected: 0.10 ml.

To calculate the molecular weight of the sample, a molecular weight calibration curve is used which is prepared using a standard polystyrene resin (e.g., trade name "TSK Standard Polystyrene F-850, F-450, F-288, F-128, F-80, F-40, F-20, F-10, F-4, F-2, F-1, A-5000, A-2500, A-1000, A-500"; available from Tosoh Corporation).

Measurement of Acid Value of Binder Resin:

The acid value is the number of milligrams of potassium hydroxide necessary to neutralize the acid contained in 1 g of a sample. The acid value of the binder resin is measured according to JIS K 0070-1992. Stated specifically, it is measured according to the following procedure.

(1) Preparation of Reagent 1.0 g of phenolphthalein is dissolved in 90 ml of ethyl alcohol (95 vol. %), and ion-exchanged water is so added thereto as to add up to 100 ml to obtain a phenolphthalein solution.

7 g of guaranteed potassium hydroxide is dissolved in 5 ml of water, and ethyl alcohol (95 vol. %) is so added thereto as to add up to 1 liter. So as not to be exposed to carbon dioxide and so forth, this solution is put into an alkali-resistant container and then left to stand for 3 days, followed by filtration to obtain a potassium hydroxide solution. The potassium hydroxide solution obtained is stored in an alkali-resistant container. For the factor of the potassium hydroxide solution, 25 ml of 0.1 mole/liter hydrochloric acid is taken into Erlenmeyer flask, and a few drops of the phenolphthalein solution are added thereto to carry out titration with the potassium hydroxide solution, where the factor is determined from the amount of the potassium hydroxide required for neutralization. As the 0.1 mole/liter hydrochloric acid, one prepared according to JIS K 8001-1998 is used.

(2) Operation (A) Run Proper:

2.0 g of binder resin having been pulverized is precisely weighed out in a 200 ml Erlenmeyer flask, and 100 ml of a toluene-ethanol (2:1) mixed solvent is added thereto to make the former dissolve in the latter over a period of 5 hours. Next, to the solution obtained, a few drops of the phenolphthalein solution are added as an indicator to carry out titration with the above potassium hydroxide solution. Here, the end point of titration is the point of time where pale deep red of the indicator has continued for about 30 seconds.

(B) Blank Run:

Titration is carried out according to the same procedure as the above except that the sample is not used (i.e., only the toluene-ethanol (2:1) mixed solvent is used).

(3) The results obtained are substituted for the following equation to calculate the acid value.

$$A=[(C-B]\times f\times5.61]/S$$

where A is the acid value (mgKOH/g), B is the amount (ml) of the potassium hydroxide solution in the blank run, C is the amount (ml) of the potassium hydroxide solution in the run proper, f is the factor of the potassium hydroxide solution, and S is the sample (g).

EXAMPLES

The present invention is described below in greater detail by giving Examples. However, the present invention is by no means limited to these.

Production of Binder Resin A-1

| | |
|---|---|
| Terephthalic acid | 70 mole parts |
| Fumaric acid | 30 mole parts |
| 1,6-Hexanediol | 80 mole parts |
| Neopentyl glycol | 20 mole parts |

Dibutyltin oxide of 0.03 part by mass in amount based on 100 parts by mass of all the acid components of the above was added to the above monomers to carry out reaction with stirring at 220.0° C. in a stream of nitrogen. While monitoring by viscosity how far the reaction proceeded, the reaction time was so controlled as for the resin to have the desired melting point to obtain a binder resin A-1. Physical properties of the resin obtained are shown in Table 2. Incidentally, the binder resin A-1 did not contain any THF-insoluble matter.

Production of Binder Resins

A-2 to A-9, A-13 to A-15

Binder resins A-2 to A-9 and A-13 to A-15 were produced in the same way as Production of Binder Resin A-1 except that the monomers were changed for those shown in Table 1. Here, the reaction time was appropriately so controlled as for each resin to have the desired melting point.

In Table 1, "Monomer added further" refers to a monomer (trimellitic anhydride) added further at a point of time where the acid value came to 5 mgKOH/g during the reaction carried out with stirring at 220.0° C. in a stream of nitrogen. Physical properties of the resin obtained are shown in Table 2. The binder resins A-2 to A-9 and A-13 to A-15 all did not contain any THF-insoluble matter.

In Table 1, "C" and "Mn" of long-chain diols stand for the number of carbon atoms and number-average molecular weight, respectively. Also, the mole parts of long-chain diols are those found by calculating the value of Mn as molecular weight.

TABLE 1

| | Formulation (mole parts) | | | | | | | |
|---|---|---|---|---|---|---|---|---|
| | Monomers introduced first | | | | | | | Monomers added |
| | Acid components | | | Alcohol components | | | | further |
| A-1 | TPA (70) | FA (30) | — | 1,6-Hexanediol (80) | NPG (20) | — | — | — |
| A-2 | TPA (95) | FA (5) | — | EG (65) | NPG (40) | — | — | TMA (15) |
| A-3 | TPA (90) | FA (10) | — | 1,3-Propanediol (5) | EG (75) | NPG (25) | — | — |
| A-4 | TPA (80) | FA (10) | TMA (10) | BPA-EO (70) | BPA-PO (30) | — | — | — |
| A-5 | TPA (85) | FA (15) | — | BPA-EO (40) | BPA-PO (60) | — | — | — |
| A-6 | TPA (80) | FA (20) | — | Methylpropanediol (5) | EG (80) | NPG (20) | — | — |
| A-7 | TPA (95) | FA (5) | — | EG (65) | NPG (40) | — | — | TMA (15) |
| A-8 | TPA (85) | FA (15) | — | BPA-EO (40) | BPA-PO (60) | — | — | — |
| A-9 | TPA (94) | TMA (6) | — | BPA-EO (100) | — | — | — | — |
| A-13 | TPA (90) | FA (10) | — | EG (70) | NPG (25) | 1,3-Proanediol (5) | Long-chain diol C (3) | — |
| A-14 | TPA (70) | FA (30) | — | 1,6-Hexanediol (80) | NPG (20) | — | Long-chain diol A (3) | — |
| A-15 | TPA (100) | — | — | EG (60) | NPG (40) | — | Long-chain diol B (2) | TMA (5) |

In Table 1;

BPA-PO: Bisphenol-A propylene oxide addition product (addition average number of moles: 2.2 moles)

BPA-EO: Bisphenol-A ethylene oxide addition product (addition average number of moles: 2.2 moles)

TPA; Terephthalic acid

TMA: Trimellitic anhydride

FA: Fumaric acid

NPG: Neopentyl glycol

EG: Ethylene glycol

Long-chain diol A: C 30, Mn 400, melting point 80° C.

Long-chain diol B: C 50, Mn 700, melting point 105° C.

Long-chain diol C: C 70, Mn 1,000, melting point 117° C.

Production of Binder Resin A-10

| | |
|---|---|
| Terephthalic acid | 32 mole parts |
| Trimellitic acid | 8 mole parts |
| Bisphenol-A propylene oxide addition product (2.2-mole addition product) | 34 mole parts |
| Bisphenol-A ethylene oxide addition product (2.2-mole addition product) | 26 mole parts |

The above polyester monomers were fed into a four-necked flask together with an esterification catalyst, and a vacuum device, a water separator, a nitrogen gas feeder, a temperature measuring device and a stirrer were fitted thereto, where the materials fed thereinto were stirred at 135° C. in an atmosphere of nitrogen. To the mixture obtained, a mixture of a vinyl copolymer (styrene: 83 mole parts; 2-ethylhexyl acrylate: 15 mole parts) with 2 mole parts of benzoyl peroxide as a polymerization initiator was dropwise added over a period of 4 hours from a dropping funnel. Thereafter, the reaction was carried out at 135° C. for 5 hours, and thereafter the reaction temperature at the time of polycondensation was raised to 230° C. to further carry out the polycondensation reaction. After the reaction was completed, the reaction product was taken out of the reaction vessel, followed by cooling and then pulverization to obtain a binder resin A-10. The binder resin A-10 obtained was a hybrid resin in which a vinyl resin unit and a polyester resin unit stood chemically combined with each other. Its physical properties are shown in Table 2. Incidentally, the binder resin A-10 did not contain any THF-insoluble matter.

Production of Binder Resin A-11

| | |
|---|---|
| Binder resin A-9 (peak molecular weight 8,000 is taken as a representative value of molecular weight to calculate its mole) | 70 mole parts |
| 1,4-Butanediol | 15 mole parts |
| Terephthalic acid | 15 mole parts |

To the above monomers, dibutyltin oxide was added in an amount of 0.03 part by mass based on all the acid components to carry out reaction with stirring at 220.0° C. in a stream of nitrogen to obtain a binder resin A-11. Its physical properties are shown in Table 2. Incidentally, the binder resin A-11 did not contain any THF-insoluble matter.

Production of Binder Resin A-12

A binder resin A-12 was obtained in the same way as Production of Binder Resin A-1 except that the 1,6-hexanediol and the terephthalic acid were added in amounts of 100 mole parts and 100 mole parts, respectively. Its physical properties are shown in Table 2. Incidentally, the binder resin A-10 did not contain any THF-insoluble matter.

TABLE 2

| | Tg (° C.) | Softening point TA (° C.) | Endothermic peak temp. (° C.) | Main peak molecular weight Mp |
|---|---|---|---|---|
| A-1 | 52 | 89 | 57 | 8,500 |
| A-2 | 52 | 99 | 57 | 6,000 |
| A-3 | 56 | 73 | 61 | 8,000 |
| A-4 | 70 | 105 | 75 | 9,000 |
| A-5 | 52 | 95 | 57 | 7,000 |
| A-6 | 50 | 100 | 55 | 10,000 |
| A-7 | 68 | 120 | 73 | 10,500 |
| A-8 | 46 | 69 | 50 | 3,000 |
| A-9 | 62 | 100 | — | 8,000 |
| A-10 | 58 | 95 | — | 5,000 |
| A-11 | 64 | 113 | 153 | 10,000 |
| A-12 | — | 105 | 117 | 5,000 |
| A-13 | 59 | 103 | 117 | 10,000 |
| A-14 | 58 | 93 | 107 | 8,000 |
| A-15 | 56 | 92 | 83 | 8,500 |

Production of Binder Resins B-1 to B-9

Binder resins B-1 to B-9 were produced in the same way as Production of Binder Resin A-1 except that monomers shown in Table 3 were used and the reaction time was controlled in order to make their melting points come to the values shown in Table 4. Here, the trimellitic anhydride was added at a point of time where, while the reaction was carried out with stirring at 220.0° C. in a stream of nitrogen, the acid value came to 5 mgKOH/g. Physical properties of the resin obtained are shown in Table 4. Incidentally, the binder resins B-1 to B-9 all did not contain any THF-insoluble matter.

In Table 3, "C" and "Mn" of long-chain diols stand for the number of carbon atoms and number-average molecular weight, respectively. Also, the mole parts of long-chain diols are those found by calculating the value of Mn as molecular weight.

TABLE 3

| | Formulation (mole parts) | | | | | |
|---|---|---|---|---|---|---|
| | Acid components | | | Alcohol components | | |
| B-1 | TPA (80) | FA (19) | TMA (1) | 1,4-CHDM (60) | EG (40) | — |
| B-2 | TPA (80) | FA (19) | TMA (1) | 1,4-CHDM (60) | EG (40) | — |
| B-3 | TPA (80) | FA (19) | TMA (1) | 1,4-CHDM (60) | EG (40) | — |
| B-4 | TPA (80) | FA (15) | TMA (5) | BPA-EO (70) | EG (30) | — |
| B-5 | TPA (80) | FA (19) | TMA (1) | 1,4-CHDM (60) | EG (40) | — |
| B-6 | TPA (80) | FA (19) | TMA (1) | 1,4-CHDM (60) | EG (40) | — |
| B-7 | TPA (80) | FA (19) | TMA (1) | 1,4-CHDM (60) | EG (40) | — |
| B-8 | TPA (80) | FA (10) | TMA (10) | BPA-EO (60) | EG (40) | — |
| B-9 | TPA (80) | FA (19) | TMA (1) | 1,4-CHDM (60) | EG (40) | Long-chain diol (3) |

In Table 3;

BPA-PO: Bisphenol-A propylene oxide addition product (addition average number of moles: 2.2 moles)

BPA-EO: Bisphenol-A ethylene oxide addition product (addition average number of moles: 2.2 moles)

TPA; Terephthalic acid

TMA: Trimellitic anhydride

FA: Fumaric acid

EG: Ethylene glycol 1,4-CHDM: 1,4-Cyclohexanedimethanol

Long-chain diol C: C 70, Mn 1,000, melting point 117° C.

TABLE 4

| | Tg (° C.) | Softening point TB (° C.) | Endothermic peak temp. (° C.) | Main peak molecular weight Mp |
|---|---|---|---|---|
| B-1 | 60 | 142 | 64 | 15,000 |
| B-2 | 55 | 132 | 60 | 12,500 |
| B-3 | 62 | 148 | 67 | 18,000 |
| B-4 | 68 | 120 | 72 | 12,000 |
| B-5 | 52 | 124 | 57 | 11,000 |
| B-6 | 66 | 157 | 71 | 23,000 |
| B-7 | 73 | 165 | 78 | 26,000 |
| B-8 | 48 | 115 | 53 | 7,500 |
| B-9 | 60 | 137 | 117 | 15,000 |

Production of Binder Resin C-1

In a 2-liter four-necked flask equipped with a nitrogen feed tube, a dewatering tube, a stirrer and a thermocouple, 80 parts by mass of the binder resin A-1 and 20 parts by mass of the binder resin B-1 were mixed, and the mixture obtained was dissolved in 300 parts by mass of toluene. Next, 1.0 part by mass of benzoyl peroxide was added to the resultant solution. Next, with heating and reflux of the mixture solution obtained, radical polymerization was carried out to cross-link the binder resin A and the binder resin B. Then, the reaction time was controlled to obtain a binder resin C-1 having THF-insoluble matter in a content of 20% by mass. The fact that the binder resin A and the binder resin B reacted with each other was confirmed from the fact that the THF-insoluble matter came.

Production of Binder Resins C-2 to C-17

Binder resins C-2 to C17 containing THF-insoluble matter in the content shown in Table 5 were produced in the same way as Production of Binder Resin C-1 except that the binder resin was changed for those as shown in Table 5 and the reaction time was controlled. The fact that the binder resin A and the binder resin B reacted with each other was confirmed from the fact that the THF-insoluble matter came.

Production of Binder Resin C-18

80 parts by mass of the binder resin A-4, 20 parts by mass of the binder resin B-6 and 1.0 part by mass of benzoyl peroxide were melt-kneaded by means of a twin-screw kneading extruder heated to 150° C. The melt-kneaded product ejected was cooled, then dried and thereafter pulverized to obtain a binder resin C-18. Its THF-insoluble matter was in a content of 20% by mass. The fact that the binder resin A and the binder resin B reacted with each other was confirmed from the fact that the THF-insoluble matter came.

Production of Binder Resins C-19 to C-31

Binder resins C-2 to C17 containing THF-insoluble matter in the content shown in Table 5 were produced in the same way as Production of Binder Resin C-1 except that the binder resin was changed for those as shown in Table 5 and the reaction time was controlled. The fact that the binder resin A and the binder resin B reacted with each other was confirmed from the fact that the THF-insoluble matter came.

TABLE 5

| | Binder resin A | | Binder resin B | | THF = insoluble |
|---|---|---|---|---|---|
| | Type | Proportion (% by mass) | Type | Proportion (% by mass) | matter (% by mass) |
| C-1 | A-1 | 80 | B-1 | 20 | 20 |
| C-2 | A-1 | 80 | B-2 | 20 | 20 |
| C-3 | A-1 | 80 | B-3 | 20 | 20 |
| C-4 | A-1 | 80 | B-4 | 20 | 20 |
| C-5 | A-1 | 80 | B-5 | 20 | 20 |
| C-6 | A-1 | 80 | B-9 | 20 | 20 |
| C-7 | A-1 | 80 | B-6 | 20 | 20 |
| C-8 | A-2 | 80 | B-1 | 20 | 20 |
| C-9 | A-3 | 80 | B-1 | 20 | 20 |
| C-10 | A-4 | 80 | B-1 | 20 | 20 |
| C-11 | A-5 | 80 | B-1 | 20 | 20 |
| C-12 | A-13 | 80 | B-1 | 20 | 20 |
| C-13 | A-14 | 80 | B-1 | 20 | 20 |
| C-14 | A-15 | 80 | B-1 | 20 | 20 |
| C-15 | A-4 | 80 | B-6 | 20 | 20 |
| C-16 | A-4 | 80 | B-6 | 20 | 10 |
| C-17 | A-4 | 80 | B-6 | 20 | 30 |
| C-18 | A-4 | 80 | B-6 | 20 | 20 |
| C-19 | A-4 | 80 | B-6 | 20 | 7 |
| C-20 | A-4 | 80 | B-6 | 20 | 32 |
| C-21 | A-4 | 60 | B-6 | 40 | 32 |
| C-22 | A-4 | 95 | B-6 | 5 | 32 |
| C-23 | A-4 | 55 | B-6 | 45 | 32 |
| C-24 | A-5 | 55 | B-7 | 45 | 32 |
| C-25 | A-6 | 55 | B-7 | 45 | 32 |
| C-26 | A-7 | 55 | B-7 | 45 | 32 |
| C-27 | A-8 | 55 | B-7 | 45 | 32 |
| C-28 | A-9 | 55 | B-8 | 45 | 32 |
| C-29 | A-10 | 55 | B-8 | 45 | 32 |
| C-30 | A-11 | 55 | B-8 | 45 | 32 |
| C-31 | A-12 | 55 | B-8 | 45 | 7 |

Example 1

Production of Toner 1

| | |
|---|---|
| Binder resin C-1 | 100 parts by mass |
| Magnetic iron oxide particles (average particle diameter: 0.20 μm) | 90 parts by mass |
| Polyethylene wax (PW2000, available from Baker Petrolite Corporation; melting point: 120° C.) | 4 parts by mass |
| Charge control agent (T-77, available from Hodogaya Chemical Co., Ltd.) | 2 parts by mass |

The above materials were premixed by means of Henschel mixer, and thereafter melt-kneaded by means of a twin-screw kneading extruder. The kneaded product obtained was cooled, and then crushed by using a hammer mill. The crushed product obtained was finely pulverized by means of a jet mill. The finely pulverized product obtained was classified by means of a multi-division classifier utilizing the Coanda effect to obtain negatively triboelectrically chargeable toner particles having a weight-average particle diameter (D4) of 6.8 μm.

In 100 parts of the toner particles, 0.8 part by mass of fine silica powder (untreated-material BET specific surface area: 300 $m^2/g$; treated with hexamethyldisilazane) and 3.0 parts by mass of strontium titanate (number-average particle diameter: 1.2 μm) were mixed by external addition, followed by sieving with a mesh of 150 μm in mesh opening to obtain a toner 1. Physical properties of the toner 1 obtained are shown in Table 6.

Evaluation

The fixing assembly of a copying machine (iRC6880N, manufactured by CANON INC.) was detached from the main body, and was converted in the following way to ready an external fixing assembly.

Its conversion points were three points that i) the process speed of the fixing assembly was made able to be set as desired, ii) the roller pressure was so controlled for the fixing nip to be 13 mm and iii) the fixing temperature was set at 200° C.

To prepare a solid-black unfixed toner image used for evaluation, a commercially available copying machine (iR5075N, manufactured by CANON INC.) from which its fixing assembly was detached was used. Its developing assembly was loaded therein with 300 g of the toner 1, where solid white images were formed on 500 sheets and thereafter the unfixed toner image was prepared in solid black (toner laid-on level was set to be 0.6 $mg/cm^2$).

Evaluation on Non-Uniform Fixing:

The solid-black unfixed toner image was formed on a reclaimed-paper transfer sheet (A4-size, 75 $g/m^2$ in basis weight), and then fixed by means of the external fixing assembly at a process speed of 600 mm/sec. Next, the like solid-black unfixed toner image was formed on the back of the image-fixed transfer sheet. Through the external fixing assembly, 10 sheets were passed to make the temperature of the fixing roller close to that at the time of continuous toner image fixing, and thereafter the solid-black unfixed toner image formed on the back was fixed through the external fixing assembly. Using the sample thus obtained, evaluation was made on non-uniform fixing.

As a way of evaluation, whether or not any non-uniform fixing occurred was visually observed on both sides of the sheet, and a difference in gloss between the surface and the back was measured with a gloss meter. Incidentally, the surface is the side having passed through the fixing assembly twice and the back is the side having passed through the fixing assembly once.

A (very good): Any non-uniform fixing is seen on both sides (the surface and the back), and the difference in gloss is less than 0.05.

B (good): Any non-uniform fixing is seen on both sides, and the difference in gloss is 0.05 or more to less than 0.10.

C (average): Any non-uniform fixing is seen on both sides, and the difference in gloss is 0.10 or more.

D (a little poor): Non-uniform fixing occurs on the surface at a level observable visually.

E (poor): Non-uniform fixing observable visually occurs on both sides.

Evaluation on High-Temperature Offset:

Subsequently, the process speed of the external fixing assembly was set at 100 mm/sec. An unfixed toner image which was solid black (toner development level on paper was set to be 0.6 $mg/cm^2$) over the whole area of 5 cm from the leading edge of the transfer material and was solid white over the other area. On this occasion, any high-temperature offset marks appearing in the white background area of the transfer material after toner image fixing and any staining of the fixing roller were visually observed to make evaluation according to the following criteria.

A (very good): Any high-temperature offset is seen to have occurred.

B (good): No problem in the white background area of the transfer material, but the fixing roller stands slightly stained.

C (average): Marks of high-temperature offset having slightly occurred are seen at edge portions of the white background area of the transfer material.

D (a little poor): Marks of high-temperature offset having occurred are seen in the white background area of the transfer material.

E (poor): Fused toner is clearly seen to have imagewise adhered to the fixing roller after toner image fixing to stain the roller.

Evaluation on Melt-Sticking to Sleeve:

The toner 1 was weighed in an amount of 300 g, and was left to stand for 12 hours in a high-temperature and high-humidity environment (30° C./80% RH) together with a commercially available copying machine (iR5075N, manufactured by CANON INC.) having been so converted as to make its process speed changeable. Thereafter, into its developing assembly, the toner 1 was loaded, and this developing assembly was idled for 1 hour under conditions of a process speed of 600 mm/sec. After its idling was completed, any streaks due to toner melt-sticking having occurred on the developing assembly were visually observed to make evaluation according to the following criteria.

A (very good): Any melt-sticking to sleeve is not seen.

B (good): One or more to two or less streak(s) appear(s) on the sleeve.

C (average): Three or more to five or less streaks appear on the sleeve.

D (a little poor): Six or more to ten or less streaks appear on the sleeve.

E (poor): Eleven or more streaks appear on the sleeve.

Examples 2 to 23 & Comparative Examples 1 to 8

Production of Toners 2 to 31

Toners 2 to 31 were obtained in the same way as Production of Toner 1 except that the binder resin was changed for those as shown in Table 6. Physical properties of the toners obtained are shown together in Table 6.

Using the toners 2 to 31 obtained, these were also evaluated in the same way as Example 1. The results of evaluation are shown in Table 7.

TABLE 6

| Toner No. | Binder resin No. | Peak temp. of tanδ (° C.) | tanδ(T + 10) | tanδ(T + 10)/tanδ(110) | G'180 (Pa) |
|---|---|---|---|---|---|
| 1 | C-1 | 62 | 1.2 | 1.0 | $6.5 \times 10^3$ |
| 2 | C-2 | 62 | 1.2 | 1.0 | $5.8 \times 10^3$ |
| 3 | C-3 | 64 | 1.2 | 1.1 | $7.5 \times 10^3$ |
| 4 | C-4 | 63 | 1.2 | 1.0 | $5.5 \times 10^3$ |
| 5 | C-5 | 62 | 1.2 | 1.0 | $5.5 \times 10^3$ |
| 6 | C-6 | 61 | 1.2 | 1.0 | $5.5 \times 10^3$ |
| 7 | C-7 | 62 | 1.2 | 1.1 | $8.0 \times 10^3$ |
| 8 | C-8 | 64 | 1.1 | 1.0 | $7.0 \times 10^3$ |
| 9 | C-9 | 56 | 1.3 | 1.3 | $7.0 \times 10^3$ |
| 10 | C-10 | 67 | 1.1 | 1.4 | $7.2 \times 10^3$ |
| 11 | C-11 | 63 | 1.2 | 1.4 | $7.0 \times 10^3$ |
| 12 | C-12 | 61 | 1.2 | 1.3 | $7.4 \times 10^3$ |
| 13 | C-13 | 62 | 1.3 | 1.3 | $7.0 \times 10^3$ |
| 14 | C-14 | 60 | 1.4 | 1.4 | $7.1 \times 10^3$ |
| 15 | C-15 | 63 | 1.1 | 0.9 | $7.0 \times 10^3$ |
| 16 | C-16 | 63 | 1.2 | 1.4 | $4.0 \times 10^3$ |
| 17 | C-17 | 63 | 1.0 | 0.9 | $2.0 \times 10^4$ |
| 18 | C-18 | 60 | 1.3 | 1.0 | $5.0 \times 10^3$ |
| 19 | C-19 | 60 | 1.4 | 0.8 | $3.0 \times 10^4$ |
| 20 | C-20 | 60 | 1.2 | 1.5 | $3.0 \times 10^4$ |
| 21 | C-21 | 63 | 1.2 | 1.5 | $2.5 \times 10^4$ |
| 22 | C-22 | 63 | 1.5 | 1.4 | $3.0 \times 10^4$ |
| 23 | C-23 | 63 | 1.0 | 0.8 | $3.0 \times 10^4$ |
| 24 | C-24 | 71 | 1.0 | 1.4 | $3.5 \times 10^4$ |
| 25 | C-25 | 67 | 1.2 | 0.7 | $3.5 \times 10^4$ |
| 26 | C-26 | 72 | 0.9 | 1.0 | $4.0 \times 10^4$ |
| 27 | C-27 | 57 | 1.6 | 1.2 | $4.0 \times 10^4$ |
| 28 | C-28 | 63 | 1.2 | 1.4 | $3.5 \times 10^4$ |
| 29 | C-29 | 60 | 0.9 | 1.0 | $4.0 \times 10^4$ |
| 30 | C-30 | 60 | 1.1 | 1.2 | $5.0 \times 10^4$ |
| 31 | C-31 | 40 | 1.6 | 0.8 | — |

TABLE 7

| | Toner No. | Non-uniform fixing | Roller staining | Melt-sticking to sleeve |
|---|---|---|---|---|
| Example: | | | | |
| 1 | Toner 1 | A | A | A |
| 2 | Toner 2 | A | A | A |
| 3 | Toner 3 | A | A | A |
| 4 | Toner 4 | A | B | A |
| 5 | Toner 5 | A | B | A |
| 6 | Toner 6 | A | B | A |
| 7 | Toner 7 | A | A | A |
| 8 | Toner 8 | A | B | A |
| 9 | Toner 9 | A | B | B |
| 10 | Toner 10 | A | C | A |
| 11 | Toner 11 | A | C | C |
| 12 | Toner 12 | A | B | B |
| 13 | Toner 13 | B | B | B |
| 14 | Toner 14 | B | B | B |
| 15 | Toner 15 | A | B | A |
| 16 | Toner 16 | B | C | B |
| 17 | Toner 17 | B | C | A |
| 18 | Toner 18 | C | C | A |
| 19 | Toner 19 | C | C | C |
| 20 | Toner 20 | C | C | A |
| 21 | Toner 21 | C | C | B |
| 22 | Toner 22 | C | C | C |
| 23 | Toner 23 | C | C | A |
| Comparative Example: | | | | |
| 1 | Toner 24 | D | E | A |
| 2 | Toner 25 | E | E | A |
| 3 | Toner 26 | E | D | A |
| 4 | Toner 27 | D | E | E |
| 5 | Toner 28 | D | E | A |
| 6 | Toner 29 | E | D | A |
| 7 | Toner 30 | E | D | A |
| 8 | Toner 31 | E | E | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-293013, filed Dec. 28, 2010, which is hereby incorporated by reference herein in its entirety.

The invention claimed is:

1. A toner comprising toner particles each of which contains a binder resin and a colorant; wherein the binder resin comprises a resin formed by the reaction of a resin (A) and a resin (B):

i) the resin (A) having a softening point TA (° C.) of from 70° C. to 105° C. and having a peak top of endothermic peaks at from 55° C. to 120° C. in a DSC curve as measured with a differential scanning calorimeter, ii) the resin (B) having a softening point TB (° C.) of from 120° C. to 160° C. and having a peak top of endothermic peaks at from 55° C. to 120° C. in a DSC curve as measured with the differential scanning calorimeter;

wherein each of the resin (A) and the resin (B) is a crystalline polyester;

and wherein in viscoelasticity characteristics of the toner measured at a frequency of 6.28 rad/sec;

I) the toner has a storage elastic modulus at temperature 180° C. (G'180) of from $3.0\times10^3$ Pa to $3.0\times10^4$ Pa, where;

II) in a chart taking temperature as x-axis and loss tangent tan δ as y-axis;

a) the loss tangent tan δ has at least one peak having a peak top within the range of from 50° C. to 70° C. and;

b) when peak top temperature affording the peak top of the peak is represented by T(° C.), the loss tangent at T+10(° C.) [tan δ(T+10)] is from 1.0 to 1.5 and;

c) the ratio of the tan δ(T+10) to the loss tangent at 110° C. [tan δ(110)], tan δ(T+10)/tan δ(110), is from 0.8 to 1.5.

2. The toner according to claim 1, wherein the resin (A) and the resin (B), when allowed to react with each other, are in a mass ratio (A:B) in the range of from 60:40 to 95:5.

* * * * *